US010294769B2

(12) United States Patent
Fortnum et al.

(10) Patent No.: US 10,294,769 B2
(45) Date of Patent: May 21, 2019

(54) OPTIMIZED LIQUID OR CONDENSATE WELL PRODUCTION

(71) Applicant: BAKER HUGHES, A GE COMPANY, LLC, Houston, TX (US)

(72) Inventors: David E. Fortnum, Calgary (CA); Srecko Zizakovic, Calgary (CA)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 175 days.

(21) Appl. No.: 15/164,457

(22) Filed: May 25, 2016

(65) Prior Publication Data

US 2016/0362970 A1 Dec. 15, 2016

Related U.S. Application Data

(60) Provisional application No. 62/173,764, filed on Jun. 10, 2015.

(51) Int. Cl.

| | |
|---|---|
| ***E21B 43/30*** | (2006.01) |
| ***E21B 33/12*** | (2006.01) |
| ***E21B 34/06*** | (2006.01) |
| ***E21B 43/12*** | (2006.01) |
| ***E21B 43/38*** | (2006.01) |

(52) U.S. Cl.

CPC ..... *E21B 43/305* (2013.01); *E21B 33/1208* (2013.01); *E21B 34/06* (2013.01); *E21B 43/128* (2013.01); *E21B 43/38* (2013.01)

(58) Field of Classification Search

CPC ..... E21B 43/30; E21B 43/24; E21B 43/25; E21B 43/128; E21B 43/305; E21B 43/12; E21B 34/06

See application file for complete search history.

(56) References Cited

U.S. PATENT DOCUMENTS

| | | | | |
|---|---|---|---|---|
| 5,988,274 | A * | 11/1999 | Funk | E21B 19/08 166/77.4 |
| 2006/0266521 | A1* | 11/2006 | Pratt | E21B 43/006 166/278 |
| 2012/0012332 | A1* | 1/2012 | Rooks | E21B 43/128 166/369 |
| 2014/0158347 | A1* | 6/2014 | Fielder | E21B 47/0007 166/250.01 |

FOREIGN PATENT DOCUMENTS

| | | |
|---|---|---|
| GB | 2327961 A | 2/1999 |
| WO | 2007026142 A1 | 3/2007 |

* cited by examiner

*Primary Examiner* — Brad Harcourt
*Assistant Examiner* — David Carroll
(74) *Attorney, Agent, or Firm* — Shawn Hunter

(57) ABSTRACT

A dedicated borehole for an ESP or artificial lift mechanism communicates with a sump or wellbore to collect liquids and/or condensate from one or more other bores where there can be laterals into a producing formation. If the ESP or artificial lift mechanism needs to be replaced the dedicated bore with the ESP or artificial lift mechanism can be closed off and the ESP or artificial lift mechanism removed without taking out the main bore or bores connected to the sump or wellbore. Those bores can continue to produce gas as liquids and/or condensate accumulate in the sump, sumps or wellbore. When the ESP or artificial lift mechanism is replaced the liquid can be pumped to surface without interruption of the gas production.

18 Claims, 2 Drawing Sheets

OPTIMIZED LIQUID OR CONDENSATE WELL PRODUCTION

CROSS REFERENCE TO RELATED APPLICATION

This application is claims priority from U.S. Provisional Patent Application Ser. No. 62/173,764 for "Optimized Liquid or Condensate Well Production", filed on Jun. 10, 2015, the disclosure of which is incorporated herein by reference in its entirety.

FIELD OF THE INVENTION

The field of the invention is wells where produced liquids are pumped to the surface by means of artificial lift and gases are produced at the same time and more particularly methods of not having to shut off gas production (and kill the well) when needing to remove the artificial lift mechanism for maintenance or replacement.

BACKGROUND OF THE INVENTION

Some ultra-high pressure wells that produce gas and liquid together employ an electric submersible pump (ESP) or artificial lift mechanism to bring the liquids to the surface. On occasion the ESP or artificial lift mechanism has to be removed for maintenance or replacement. Typically the ESP or artificial lift mechanism is located in the main bore that may or may not have multiple laterals. During normal operations, the produced liquids migrate into the artificial lift mechanism intake. Produced gas typically flows to surface, especially if under pressure. Known separation equipment separates the liquid and gas phases at the surface.

If the artificial lift mechanism needs to be pulled the gas production has to be curtailed as well control techniques for the well need to hold back the high formation pressures as the artificial lift mechanism is pulled out from the well in a safe manner with the formation pressures isolated. This can be accomplished by killing the well with heavy fluids or pulling the artificial lift mechanism through formation isolation valves and closing such valves as the artificial lift mechanism is pulled up past such valves. No matter which way the replacement of the artificial lift mechanism is accomplished, the gas production from the well is interrupted and liquids accumulate in the borehole. If this happens, it is sometimes difficult to regain the previous production rates.

It is known in the field of oil and gas production to use artificial lift techniques to increase the flow rate of wells having a reduced bottom hole pressure. One method of artificial lift is to incorporate an ESP in the production tubing to pump the fluids to the surface of the well. The ESP can either be directly in the production tubing or located in parallel with bypass tubing. In this second arrangement a Y-Block is located in the production tubing wherein the ESP is supported from a first limb and the bypass tubing is supported from the second limb. The parallel arrangement is used when equipment needs to be run to a location below the ESP in the well. One disadvantage of such systems is the space they take up making them impractical for many applications.

A known disadvantage of these systems even when they can be practically employed as space is not a concern, occurs when the ESP is switched off. On switching off the pump, the fluid column in the production tubing above ESP drains back through the pump, which can cause reverse rotation of the pump and sand can settle in the pump. As such, scale, wear and debris build up at the ESP causing damage and potential failure of the ESP. A further disadvantage of the parallel arrangement is that a blanking plug must be installed in the bypass tubing at the isolation packer for well control. When the ESP is in use to prevent produced fluids re-entering the well through the bypass tubing, an auto-check or flapper valve in the Y-Tool is used to control the flow. This is a costly exercise as a wireline or other string must be inserted through the production tubing to carry the plug to the isolation packer or device.

An automatic blanking completion tool has been proposed in GB 2 327 961 in the form of a modified Y-Block which automatically seals the ESP, when the ESP is switched off, and seals the bypass when the ESP is running. This tool operates on the differential pressure between the bypass tubing and the ESP. A hinged flapper or a rolling ball mechanism is mounted in the Y-Block at the point where the two limbs meet. The flapper or a rolling ball mechanism is biased towards an open position where it covers the access to the ESP. When the ESP is switched on, the increase in pressure, forces the flapper or a rolling ball mechanism over to cover the access to the bypass tubing. Additionally when the ESP is switched off, the bias will return the flapper or a rolling ball mechanism to cover the ESP. As fluid pressure operates the tool, no intervention is required and the tool is automatic.

While the automatic blanking tool advantageously prevents detritus entering the ESP when not in use detritus falling on the flapper or a rolling ball mechanism when in the closed position will automatically be ejected into the ESP when the ESP is switched off. This can damage the ESP as described above.

An improvement claiming to address such problems is discussed in WO/2007/026142A1. These systems are expensive, still have reliability issues and cannot fit it many applications without forcing the borehole to be significantly enlarged to accommodate the Y-Block.

The present invention seeks to provide a system where the gas production can continue when the ESP or artificial lift mechanism is removed. The ESP or artificial lift mechanism is disposed in a discrete bore from the main borehole sump but is in fluid communication with the sump or wellbore. The sump or wellbore can serve multiple wells that each may have multilaterals in such an orientation that permits the produced gas to move up to the surface as the liquids or condensate produced collects in the sump or wellbore. One or more boreholes can share a common sump or wellbore and each well need not necessarily have multiple laterals. These and other features of the present invention will be more readily apparent to those skilled in the art from a review of the detailed description of the preferred embodiment and the associated drawings while recognizing that the full scope of the invention is to be determined from the appended claims.

SUMMARY OF THE INVENTION

A dedicated borehole for an ESP or artificial lift mechanism communicates with a sump or wellbore to collect liquids and/or condensate from one or more other bores where there can be laterals into a producing formation. If the ESP or artificial lift mechanism needs to be replaced the dedicated bore with the ESP or artificial lift mechanism can be closed off and the ESP or artificial lift mechanism removed without taking out the main bore or bores connected to the sump or wellbore. Those bores can continue to produce gas as liquids and/or condensate accumulate in the sump, sumps or wellbore. When the ESP or artificial lift mechanism is replaced the liquid can be pumped to surface without interruption of the gas production.

DETAILED DESCRIPTION OF THE PREFERRED EMBODIMENT

Figure 1:
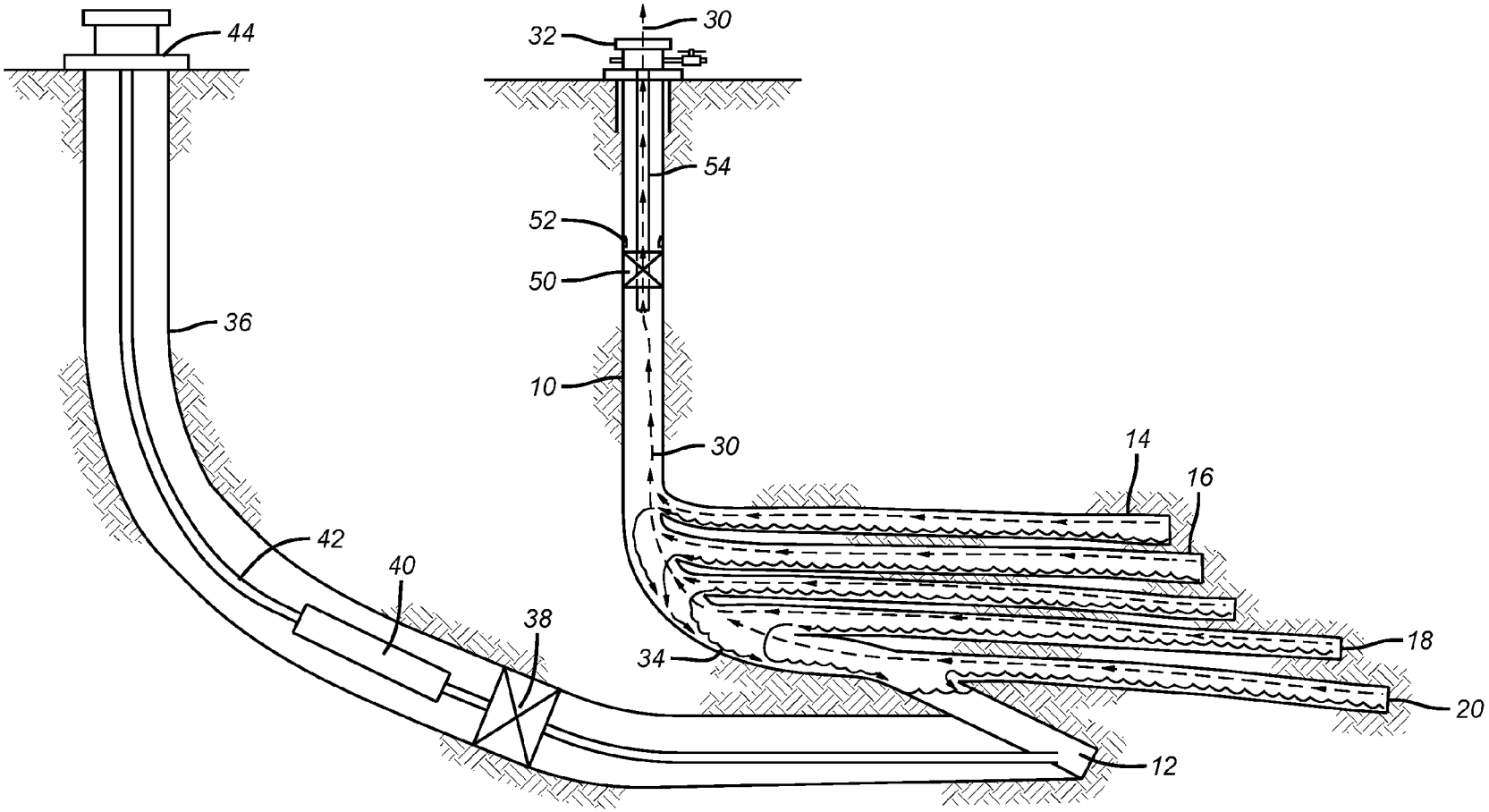
FIG. 1 illustrates the dedicated ESP or artificial lift mechanism bore joining a sump or wellbore connected to at least one main producing bore.
Figure 2:
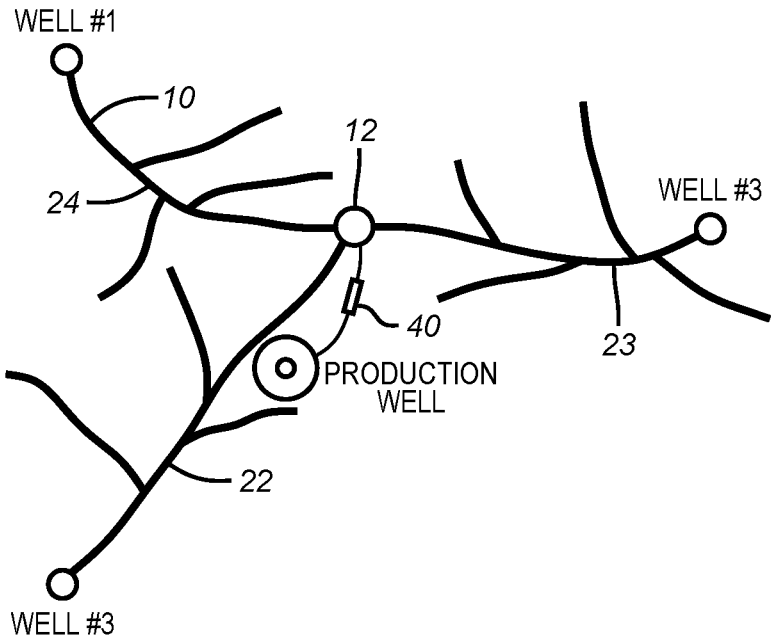
FIG. 2 illustrates multiple producing bores in a common liquid collection sump or wellbore.

FIG. 1 shows a main bore 10 that leads to a sump/wellbore 12 below laterals 14, 16, 18 and 20. Another bore or bores 22, 23 and 24 can feed into sump/wellbore 12 as shown in FIG. 2. These bores 22, 23 and 24 can also have many laterals along the same lines as shown for bore 10. Arrows 30 represent the gas being produced to the surface 32. Arrows 34 represent the liquid or condensate going into sump/wellbore 12.

To remove the condensate or liquids represented by arrow 34 to the surface 32 an auxiliary bore 36 has a formation isolation valve 38 with an electric submersible pump (ESP) or artificial lift mechanism 40 connected to a string 42 leading to another surface location 44. With the illustrated arrangement, the valve 38 can be closed to allow safe removal of the ESP or artificial lift mechanism 40 while at the same time gas flow represented by arrows 30 continues to flow. Since the gas flow is not interrupted as liquids build in sump/wellbore 12 while the ESP or artificial lift mechanism 40 is being serviced or replaced there is no subsequent production loss from the formation due to shutting in the flow or killing the well.

Production packer 50 can also have a nipple profile 52 associated with it. A production string 54 leads to the surface 32. Packer 50 can be of a high temperature and high pressure service design. Profile 52 can accept a plug that is not shown for further isolation of the borehole if needed.

This setup can be contrasted with one of the ways the components were arranged before where the ESP or artificial lift mechanism was in the sump/wellbore and all production had to stop to get the ESP or artificial lift mechanism changed out or serviced. While using an auxiliary bore 36 is an expense it should be noted the rig equipment is already on site and the versatility of being able to continue production while replacing the ESP or artificial lift mechanism 40 in the end can be worth more than the cost of drilling the bore 36 because peak gas production continues rather than being attenuated after being shut in. The proposed alternative compares favorably with the incremental cost of drilling a single well with the addition of the Y-Block and the additional complications that such a design adds to the drilled cost and potential for other shutdowns for maintenance of complex components. The design using multiple wellbores that may or may not have multilateral legs in any configuration is to promote maximum exposure to the reservoir. Directing flow of liquids or condensate into one wellbore or sump eliminates the need for multiple ESPs or artificial lift systems in multiple wells. Not only is this a capital cost reduction but at the same time, the design allows for continuous gas production to surface irrespective of a well intervention relative to the ESP or artificial lift system. The concept lends itself to a much more favorable economic model with greater continuous production exposure.

The above description is illustrative of the preferred embodiment and many modifications may be made by those skilled in the art without departing from the invention whose scope is to be determined from the literal and equivalent scope of the claims below:

We claim:

1. A well configuration, comprising:

at least one main borehole comprising multiple discrete laterals that drain into said main bore to conduct produced liquid from the formation into a collection sump where said main bore terminates, said main borehole conducting produced gas from the formation to a first remote location in an uphole direction;

an auxiliary borehole further comprising an artificial lift device and terminating at said sump for selective removal of only said produced liquid to a second remote location;

a barrier in said auxiliary bore selectively closed to allow removal of said artificial lift device while continuing to produce gas to the first remote location through said main borehole.

2. The well configuration of claim 1, wherein:

said main borehole comprises at least one lateral oriented to allow produced liquid to collect in said sump.

3. The well configuration of claim 1, wherein:

said artificial lift device comprises an electric submersible pump.

4. The well configuration of claim 1, wherein:

said main borehole is oriented to allow gravity drainage of produced liquids to said sump.

5. The well configuration of claim 1, wherein:

said main borehole further comprises a packer with a nipple profile adapted to accept a plug.

6. The well configuration of claim 1, wherein:

produced gas and liquid separate from each other in said sump.

7. The well configuration of claim 6, wherein:

said artificial lift device comprises an electric submersible pump.

8. The well configuration of claim 7, wherein:

said main borehole is oriented to allow gravity drainage of produced liquids to said sump.

9. The well configuration of claim 8, wherein:

said main borehole further comprises a packer with a nipple profile adapted to accept a plug.

10. The well configuration of claim 9, wherein:

produced gas and liquid separate from one another in said sump.

11. A production method, comprising:

providing a main borehole comprising multiple laterals that drain back produced fluids to said main borehole with said main borehole terminating at a sump;

providing an auxiliary borehole terminating into said sump;

producing only liquids with an artificial lift device in said auxiliary borehole from said sump;

producing only formation gas from said main borehole regardless of whether said auxiliary borehole is or is not in service.

12. The method of claim 11, comprising:

removing said artificial lift device from said auxiliary borehole while producing gas from said main borehole.

13. The method of claim 11, comprising:

providing at least one lateral from said main borehole.

14. The method of claim 11, comprising:

locating said sump for gravity liquid drainage into said sump from said main borehole.

15. The method of claim 11, comprising:

providing an isolation valve in said auxiliary borehole between said artificial lift device and said sump.

16. The method of claim 11, comprising:

providing an electric submersible pump as said artificial lift device.

17. The method of claim 11, comprising:

providing a packer with a nipple profile adapted to accept a plug in said main borehole.

18. The method of claim 11, comprising:

separating produced gas from produced liquid in said sump.

* * * * *